US009920894B2

(12) United States Patent
Briggs et al.

(10) Patent No.: US 9,920,894 B2
(45) Date of Patent: Mar. 20, 2018

(54) LUMINAIRE BULLET CATCH MOUNTING TEXTURE

(71) Applicant: PHILIPS LIGHTING HOLDING B.V., Eindhoven (NL)

(72) Inventors: Andrew Briggs, Eindhoven (NL); Brandon Crooks, Eindhoven (NL); Timothy Farrell, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/037,673

(22) PCT Filed: Nov. 11, 2014

(86) PCT No.: PCT/IB2014/065942

§ 371 (c)(1),
(2) Date: May 18, 2016

(87) PCT Pub. No.: WO2015/075599

PCT Pub. Date: May 28, 2015

(65) Prior Publication Data

US 2016/0290576 A1 Oct. 6, 2016

Related U.S. Application Data

(60) Provisional application No. 61/905,901, filed on Nov. 19, 2013.

(51) Int. Cl.
*F21V 7/00* (2006.01)
*F21S 8/02* (2006.01)
(Continued)

(52) U.S. Cl.
CPC ..... *F21S 8/026* (2013.01); *F21V 3/00* (2013.01); *F21V 7/00* (2013.01); *F21V 15/01* (2013.01);
(Continued)

(58) Field of Classification Search
CPC .... F21S 8/026; F21V 3/00; F21V 7/00; F21V 23/003; F21V 29/70; F21V 15/01;
(Continued)

(56) References Cited

U.S. PATENT DOCUMENTS 3,563,584 A 2/1971 Schwartzman
5,183,330 A 2/1993 Rishel et al.
(Continued)

FOREIGN PATENT DOCUMENTS

DE 9321519 U1 1/1999
EP 1674792 A2 6/2005
(Continued)

OTHER PUBLICATIONS

Machine English Translation of EP2202451A1 Jun. 30, 2010; Hierzer Andreas.*

*Primary Examiner* — Elmito Breval
*Assistant Examiner* — Glenn Zimmerman

(57) ABSTRACT

Recessed lighting rough-in section (i.e. housing) and finishing section (i.e. luminaire module) including a textured surface and catch mechanism is disclosed. The luminaire module includes a textured surface that is oriented along a diagonal, a coiled path or an orbital path of rows of recesses which engage corresponding catch mechanisms. Coarse adjustment of the height of the luminaire module may be determined by moving the luminaire module vertically and fine adjustment may be determined by rotation of the luminaire module with respect of the catch mechanisms.

15 Claims, 6 Drawing Sheets

(51) Int. Cl.

| | |
|---|---|
| ***F21V 15/01*** | (2006.01) |
| ***F21V 21/04*** | (2006.01) |
| ***F21V 21/14*** | (2006.01) |
| ***F21V 29/70*** | (2015.01) |
| ***F21V 3/00*** | (2015.01) |
| ***F21V 23/00*** | (2015.01) |
| *F21Y 101/00* | (2016.01) |

(52) U.S. Cl.
CPC ..... *F21V 21/04* (2013.01); *F21V 21/041* (2013.01); *F21V 21/14* (2013.01); *F21V 23/003* (2013.01); *F21V 29/70* (2015.01); *F21Y 2101/00* (2013.01)

(58) Field of Classification Search
CPC ..... F21V 21/04; F21V 21/14; F21V 21/041; F21Y 2101/00
USPC ..... 362/341, 364, 285
See application file for complete search history.

(56) References Cited

U.S. PATENT DOCUMENTS

| | | | | |
|---|---|---|---|---|
| 5,673,997 | A | 10/1997 | Akiyama | |
| 7,399,104 | B2 | 7/2008 | Rappaport | |
| 2009/0052194 | A1 | 2/2009 | Jowid | |
| 2010/0002443 | A1* | 1/2010 | Schultheis | F21V 33/0012 362/282 |
| 2013/0155711 | A1* | 6/2013 | Ducker | F21S 48/1104 362/519 |

FOREIGN PATENT DOCUMENTS

| | | | |
|---|---|---|---|
| EP | 1739347 | A1 | 1/2007 |
| EP | 2202451 | A1 | 12/2009 |
| EP | 2357401 | A2 | 2/2011 |
| GB | 1044887 | | 10/1966 |

* cited by examiner

LUMINAIRE BULLET CATCH MOUNTING TEXTURE

CROSS-REFERENCE TO PRIOR APPLICATIONS

This application is the U.S. National Phase application under 35 U.S.C. § 371 of International Application No. PCT/IB32014/065942, filed on Nov. 11, 2014, which claims the benefit of U.S. Patent Application No. 61/905,901, filed on Nov. 19, 2013. These applications are hereby incorporated by reference herein.

This application is related to the field of lighting and more particularly to a system for providing precise placement of recessed lighting fixtures.

Recessed lighting fixtures may consist of a rough-in section (i.e., housing) that include a junction box that allows for a connection to an electrical source, additional features to secure the rough-in section in the ceiling, and may or may not include a socket connection. In addition to a rough-in section, a recessed lighting fixture can include a finishing section (i.e., luminaire module) that may or may not include a socket connection. The socket connection allows for a connection to a light source such as a lamp (e.g., a light bulb), a Light Emitting Diode (LED), or an LED array. A recessed light fixture may also include a trim section that provides a decorative covering that covers the hole into which the rough-in section and/or finishing section is inserted through or is mounted above. The trim section may also provide a decorative finish to the viewable area of an internal surface of the recessed light fixture.

Conventional methods of retaining finishing sections within a ceiling consist of friction retention springs or stepped ladders within the rough-in section. The friction retention spring method includes a plurality of retention springs within the rough-in section of the recessed light fixture. The retention springs, when under stress, generate an excessive counterforce between the finishing section and the rough-in section. The excessive force of the retention springs locks the finishing section in position. The visible trim section, which may be included in the finishing section, may then be fitted into the retained finishing section if it is separate in design.

However, upon installing the finishing section, the force generated by the springs may cause the rough-in section mounting bars to flex, thereby lifting the whole rough-in section above the ceiling, which prevents a flush installation of the finishing section and/or rough-in section and or trim section against the ceiling. In addition, the springs are generally made of a metal having sharp edges that may generate a safety hazard when installing or removing the finishing section.

The stepped ladders method offer a comparatively complex vertical adjustment mechanism that requires a greater number of components and a lengthier procedure to effectively secure the finishing section and/or trim section in place inside the rough-in section. The stepped ladders method utilize an adjustment mechanism that offer height adjustments of no less than one-eight (⅛) of an inch.

Hence, there is a need in the industry for a recessed lighting fixture that provides a simple means for securing a luminaire module that is simple to install and allows for a flush fit.

It is an object of the present invention to provide an easier (requiring less force) and simpler (requiring less steps) system to position a luminaire module within a housing.

It is an object of the present invention to provide a system for positioning a luminaire module substantially flush with a ceiling surface.

It is an object of the present invention to provide a system for allowing for a substantially flush position of the housing with a ceiling surface.

In accordance with the principles of the invention, a recessed light fixture assembly is disclosed. The assembly comprises a luminaire module element including at least one textured surface covering a surface of luminaire module in whole or in part, the textured surface including a plurality recesses arranged in a plurality of rows, the plurality of rows being oriented along a diagonal line, a coiled path or an orbital path and a retaining ring surrounding the luminaire module element. The retaining ring including at least one catch mechanism engaging the textured surface. The luminaire module, the retaining ring and the catch mechanism(s) may be mounted on a plate, which may be attached to a recessed housing that is attached to a ceiling, or may be attached directly to a ceiling.

In another aspect of the invention, a luminaire module is disclosed. The luminaire module comprises a casing including an inner surface and an outer surface, the outer surface including at least one textured pattern partially covering the outer surface, the textured pattern including a plurality recesses arranged in a plurality of rows, the plurality of rows being oriented along a diagonal line (i.e., a coiled path or an orbital path).

The advantages, nature, and various additional features of the invention will appear more fully upon consideration of the illustrative embodiments to be described in detail in connection with the accompanying drawings wherein like reference numerals are used to identify like elements throughout the drawings.

It is to be understood that the figures and descriptions of the present invention described herein have been simplified to illustrate the elements that are relevant for a clear understanding of the present invention, while eliminating, for purposes of clarity only, many other elements. However, because these eliminated elements are well-known in the art, and because they do not facilitate a better understanding of the present invention, a discussion of such elements or the depiction of such elements is not provided herein. The disclosure herein is directed also to variations and modifications known to those skilled in the art.

It will be further understood that the present invention is described with regard to a specific implementation of a recessed light fixture. However, it would be appreciated that the present invention may also be applicable to other types of fixtures without altering the scope of the invention.

Figure 1:
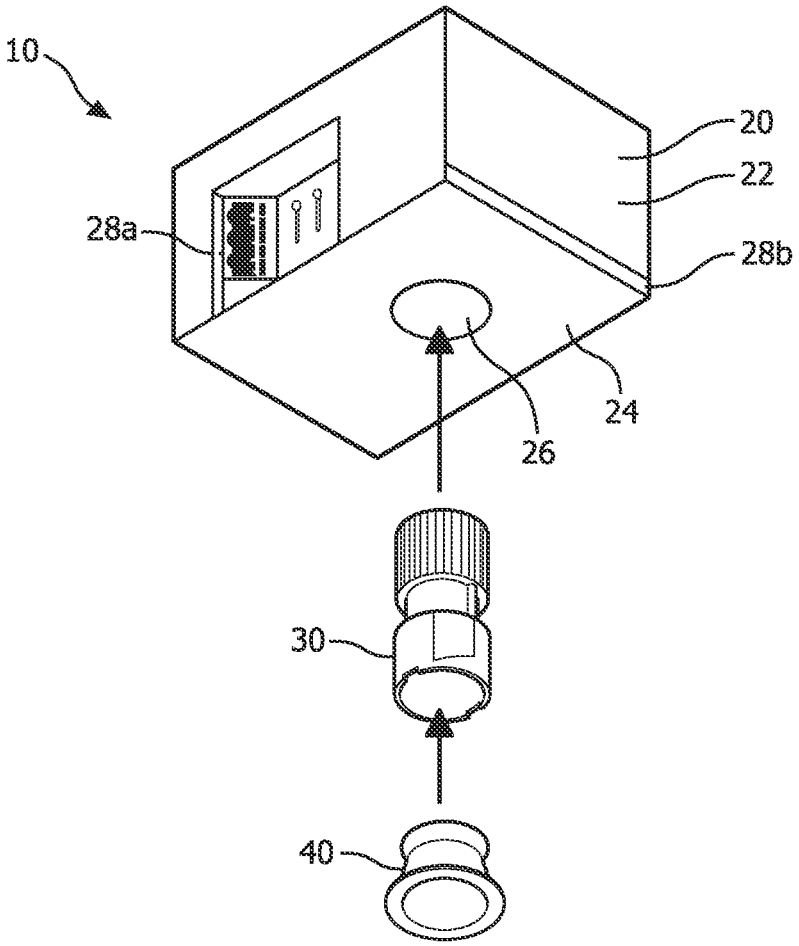
FIG. 1 illustrates a prospective view of a recessed light fixture.

With reference to FIG. 1, there is shown typical components of a recessed light fixture 10.

Generally, the light fixture 10 includes a rough-in section 20, represented as a housing or a frame in kit, that consists of either a box shaped housing 22 (or other shape) that is enclosed above a ceiling (not shown). The rough-in section 20 may also include a plate 24 that includes an opening 26 through which a light (or light source) may be inserted. The housing 22 may further include mounting hardware 28 (i.e., 28*a*, 28*b*) that retains the rough-in section 20 securely in the ceiling. In many cases, rough-in section 20 contains the wiring and/or electronics (not shown) to "drive" the light that is connected therein. The wiring and/or electronics may be used to "drive" a conventional light bulb or the newer Light Emitting Diode (L.E.D.) lights that are replacing the conventional light bulb.

Light fixture 10 further includes a finishing section 30 that may be visible to a user when viewed. The finishing section 30 provides a finished appearance to the recessed light fixture 10. In one case, the finishing section may represent a conical shape that redirects light (i.e., a reflector) emitted by an omnidirectional light source (e.g., a conventional incandescent light bulb) in a desired direction. In another case, the finishing section 30 may include an opening (not shown) through which a conventional light bulb may be screwed into an electrical socket within the housing. The electrical socket is typically mounted in the housing 22 and may be visible through the hole in the finishing section 30. Thus, a light bulb may be positioned within the hole in the finishing section to engage the electrical socket.

Alternatively, finishing section 30 may represent a luminaire module that consists of an LED array, a thermal interface, a heat sink, a casting "body" and associated wiring. In this aspect of the invention, the LED array is the light source. Finishing section 30 is retained in housing 22 in accordance with the principles of the invention.

Also illustrated is trim section 40. Trim section 40 represents, in many instances, a purely decorative item that satisfies Underwriting Laboratory (UL) standards. In some cases, the trim section 40 is required for safety reasons. Generally, the trim section 40 is a visually appealing piece that is placed last in the recessed light fixture 10. Trim section 40 may further assist in focusing or diffusing the light emitted by the light source, or cover-up unsightly seams/edges and may come in a variety of colors. The trim section 40 can be something large as a full reflector cone or something as simple as a trim edge that you place on the ceiling.

Figure 2:
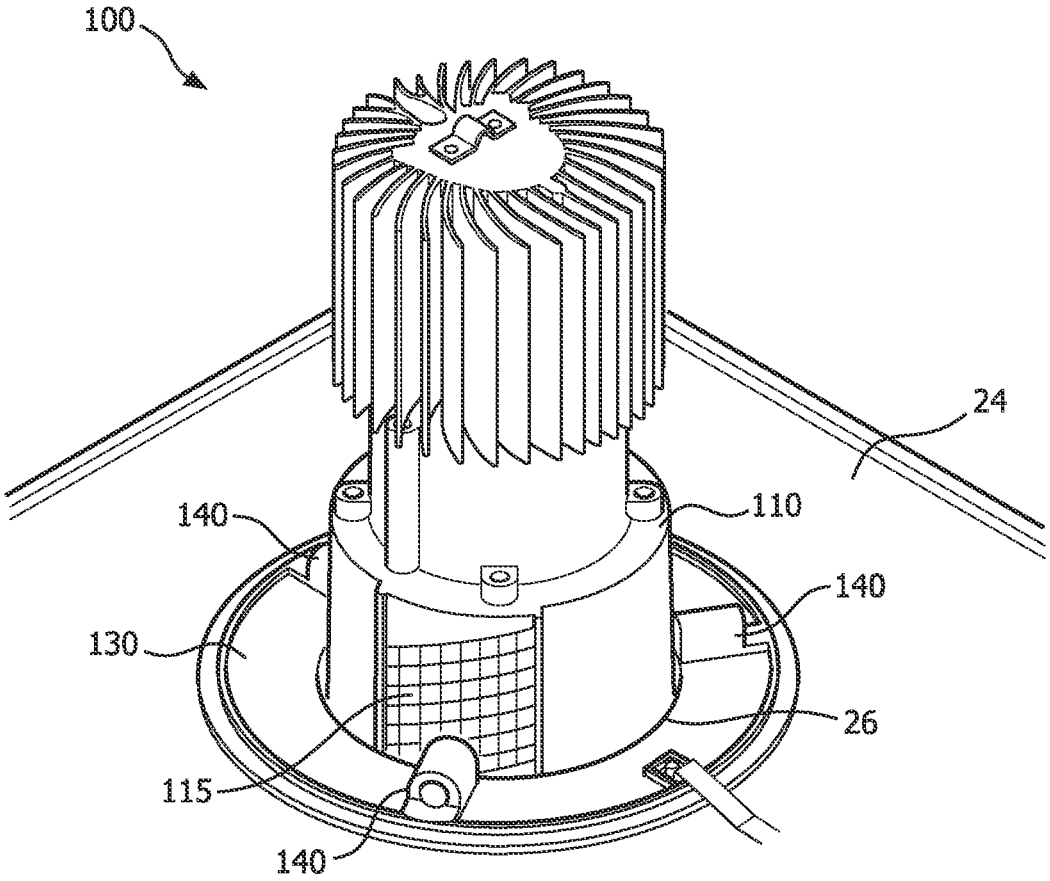
FIG. 2 illustrates a prospective view of an exemplary recessed light fixture in accordance with the principles of the invention.

FIG. 2 illustrates a prospective view of a recessed light fixture 100 in accordance with the principles of the invention.

Referring to FIG. 2, there is shown a finishing section 30 (represented as luminaire module 110) installed in an opening 26 in plate 24. Also shown is a retaining ring 130 positioned on plate 24 surrounding opening 26.

Plate 24 may represent an assembly that may be directly attached to a ceiling. In an alternate embodiment, plate 120 may be attached to a housing 22 (not shown). The attachment of plate 24 to a ceiling (not shown) or housing 22 may be a friction fit, a spring fit, a snap fit or other means of attachment using more traditional hardware (i.e. screws, rivets etc.). The housing 22 may be attached to a ceiling in a conventional manner (i.e. screws, nails, retaining pins, joist hangers or other building materials).

Retaining ring 130 includes at least one catch mechanism 140 that engages the luminaire module 110. Luminaire module 110 further includes at least one texture surface 115. Texture surface 115 includes a plurality of recesses 145 oriented in a plurality of rows 114. As shown, the rows 114 are oriented along a diagonal line (i.e., a coiled path or an orbital path) to allow upward or downward positioning of luminaire module 110, as will be further explained.

In the illustrated embodiment shown, three catch mechanisms are shown. However, it would be understood that the number of catch mechanisms 140 may be increased and/or decreased without altering the scope of the invention. In addition, the orientation of the catch mechanisms with respect to each other may be selected to provide a secure retention of luminaire module 110. In one aspect of the invention, the catch mechanism(s) 140 may be oriented equally around luminaire module 110 to provide substantially equal pressure or force on luminaire module 110. For example, in the illustrated example shown in FIG. 2, the three catch mechanisms may be oriented at 120 degrees with respect to each other to provide substantially equal force on luminaire module 110.

Although not shown, it would be recognized that a number of textures surfaces on outer surface of luminaire module 110 may be comparable to or greater than a number of catch mechanisms 140 on retaining ring 130.

Figure 3:
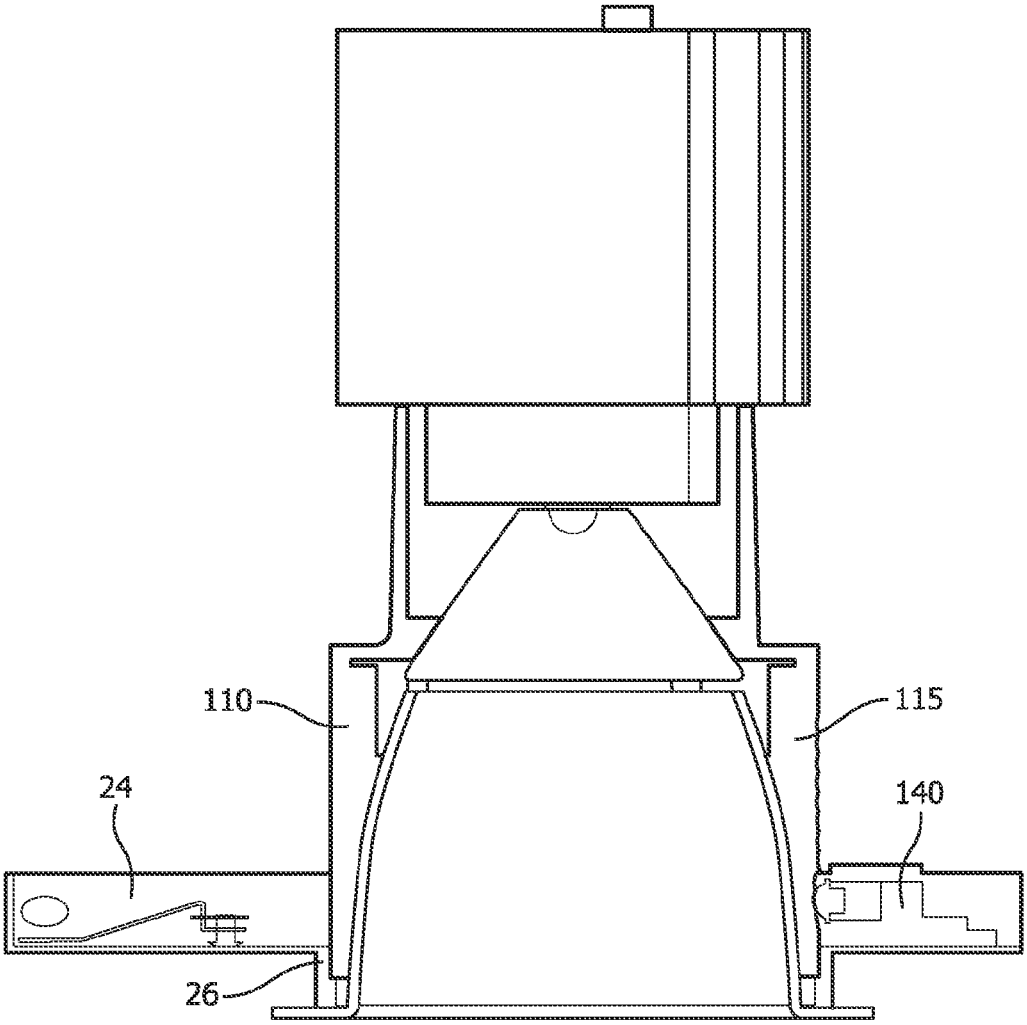
FIG. 3 illustrates a cross-sectional view of an exemplary recessed light fixture in accordance with the principles of the invention.

FIG. 3 illustrates a cross-sectional view of the luminaire module 110 and catch mechanism 140 shown in FIG. 2.

Referring to FIG. 3, there is shown luminaire module 110 projecting through opening 26 in plate 24. A catch mechanism 140 is shown engaging an outer surface of the luminaire module 110. In this illustrated case, luminaire module 110 may be raised or lowered into plate 24 by rotating luminaire module 110 clockwise or counterclockwise, respectively. Thus, as the catch mechanism slides from one recess 145 in the texture surface 115 to an adjacent second recess 145 in the texture surface 115, the luminaire module 110 may be raised or lowered by a desired amount. Hence, in accordance with the principles of the invention, the catch mechanism 140 may engage a horizontally adjacent second recess to raise (or lower) the luminaire module 110 by a first desired amount as the luminaire module is rotated. Alternatively, the catch mechanism 140 may engage a vertically adjacent second recess to raise (or lower) the luminaire module 110 by a second desired amount.

Although, texture surface 115 is shown to be oriented on a positive slope or diagonal line or coil path, with respect to a horizontal line, it would be appreciated that texture surface 115 may be oriented on a negative slope or diagonal line or coil path with respect to a horizontal line, without altering the scope of the invention.

Figure 4:
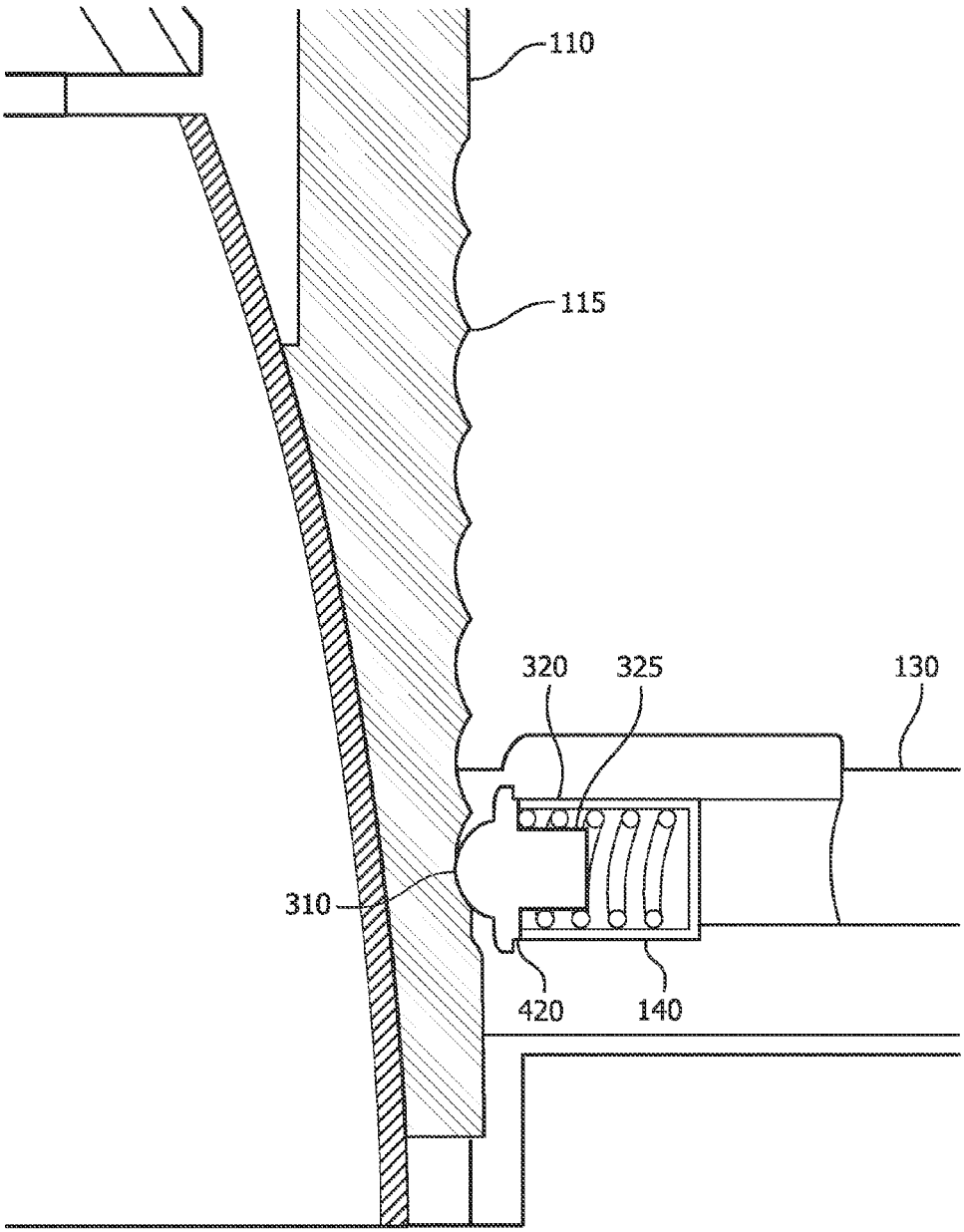
FIG. 4 illustrates an expanded view of the exemplary recessed light fixture shown in FIG. 3.

FIG. 4 illustrates a further expanded cross-sectional view of the luminaire module 110 and catch mechanism 140 in accordance with the principles of the invention.

In this illustrated embodiment, catch mechanism 140 is shown having a slideable element having a substantially round front end 310 and a substantially flat back end 325. Also shown is lip 420 that retains spring 315 within the housing 320.

Catch mechanism 140 may represent a bullet-catch or ball-catch type mechanism that includes a first end 310 that extends from, and is slideable into, a catch mechanism housing 320. In one aspect of the invention, the front surface of first end 310 is one of a round shape, a spherical shape or a conical shape.

Referring to FIG. 4, there is shown texture surface 115 on an outer surface of luminaire module 110 with catch mechanism 140 engaging texture surface 115. Catch mechanism 140 is shown having a first end 310 that extends from bullet catch housing 320 to slideably engage recesses 145 in texture surface 115. Within bullet catch housing 320 is shown spring 315 situated between a back end of bullet catch housing 320 and a back end 325. Spring 315 pushes against a back end of bullet catch housing 320 and back end 325 to apply a pressure (or force) to first end 310. The force applied to first end 320 is sufficient to retain first end 310 in an extended position.

Figure 5:
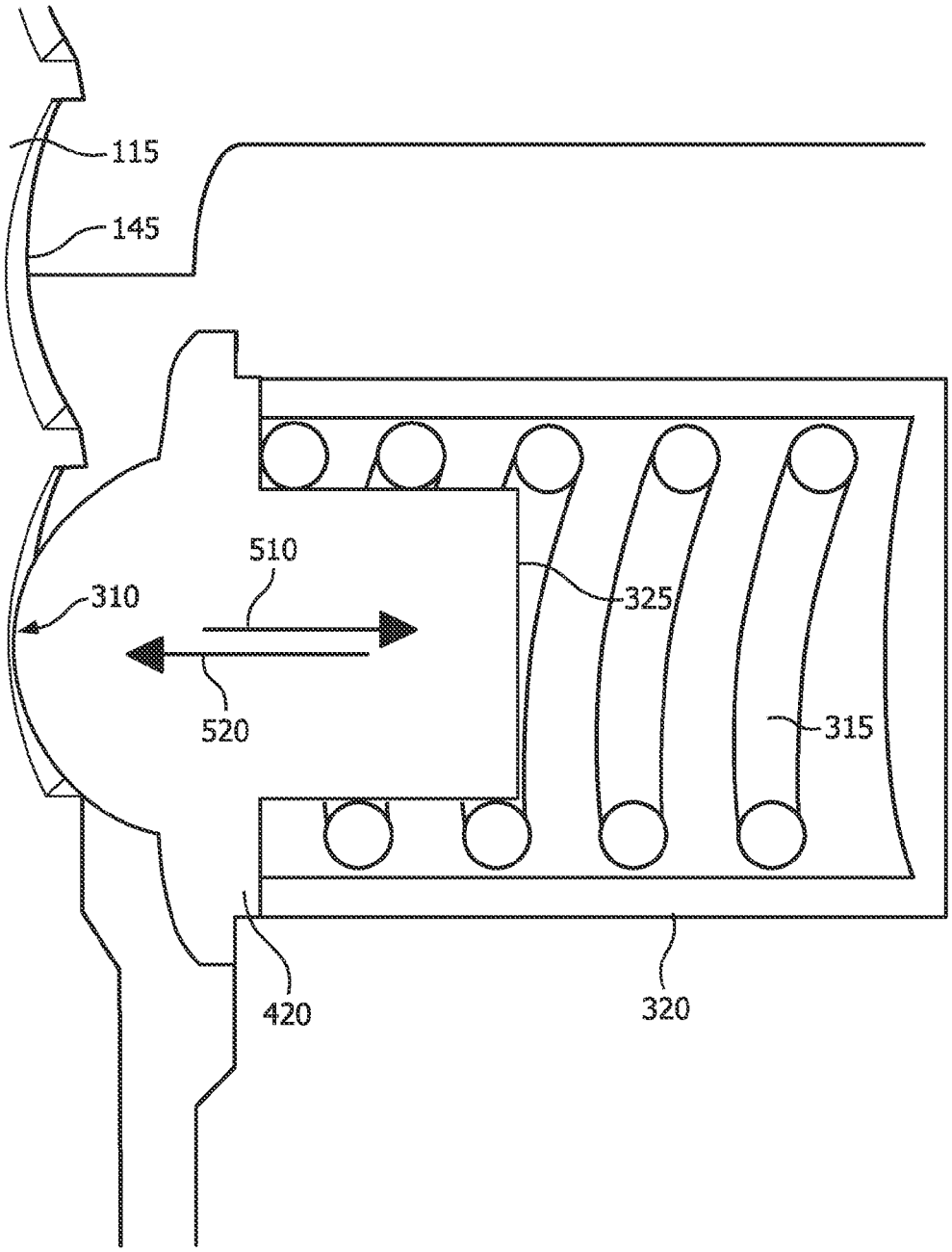
FIG. 5 illustrates a further expanded view of the exemplary recessed light fixture shown in FIG. 3.

FIG. 5 illustrates a still further expanded cross-sectional view of the catch mechanism 140. In this illustrated embodiment, the movement of first end 310 is indicated by the horizontal arrows 510, 520. Horizontal arrow 510 represents movement of first end 310 into catch mechanism housing 320. Horizontal arrow 520 represents movement of first end 310 extending from catch mechanism housing 320. Spring 315, which is positioned between an end of the bullet catch housing 320 and the back end 325 provides a force to maintain first end 310 in an extended position.

As would be recognized in the art, when a force, which is greater than the force applied to back end 325 by spring 315, is applied to a front surface of first end 310, spring 315 compresses and first end 310 slideably enters bullet catch housing 320 (horizontal arrow 520).

Figure 6:
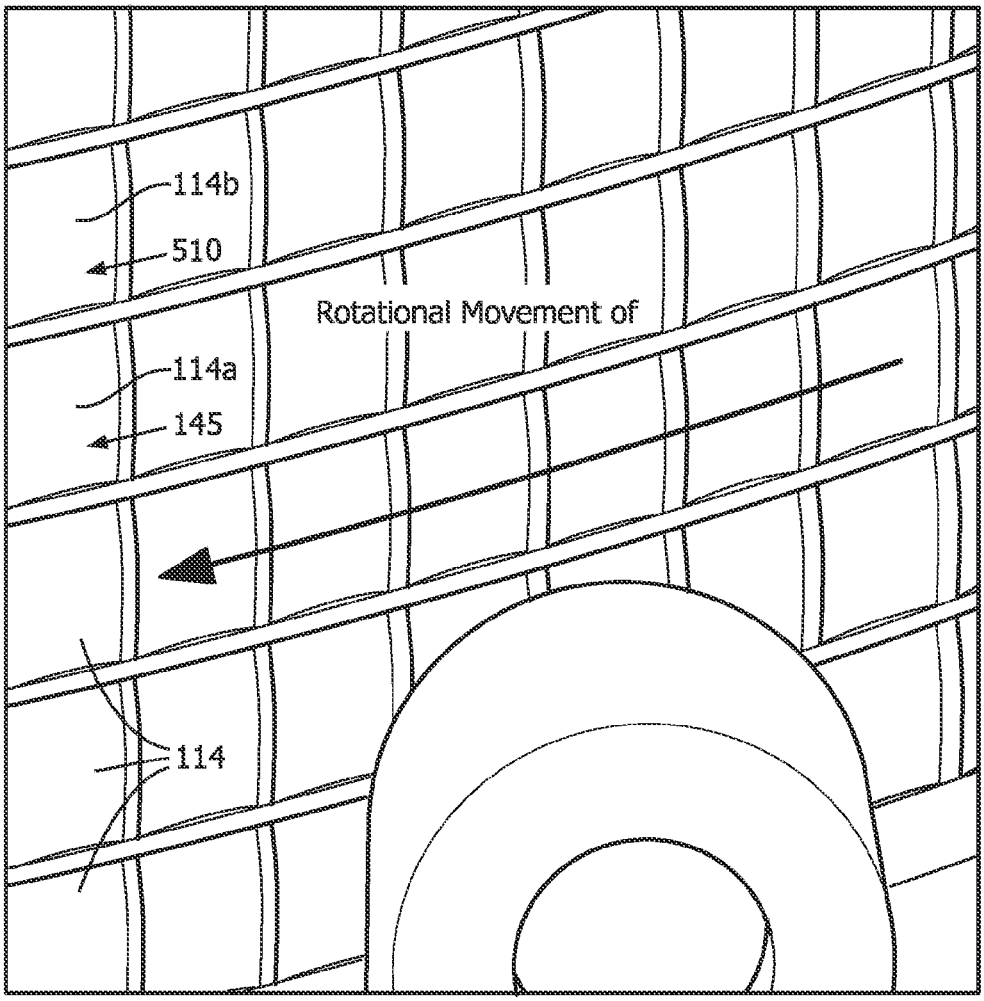
FIG. 6 illustrates an expanded view of the texture surface of the recessed light fixture in accordance with the principles of the invention.

FIG. 6 illustrates an expanded view of an exemplary texture surface 115 on luminaire module 110 in accordance with the principles of the invention.

Referring to FIG. 6, texture surface 115 comprises a plurality of recesses 145 and separating ridges 510, aligned in rows 114. The rows 114 are oriented along a diagonal, a coiled path or an orbital path so as to allow a vertical movement of luminaire module 110 as luminaire module 110 is rotated with respect to catch mechanisms 140. In the exemplary embodiment shown, the front surface of first end 310 engages a recess 145 and, thus, is extended from the bullet catch housing 320. However, as luminaire module 110 is rotated, the first end 310 is positioned along separating ridge 510, which applies a force to first end 310 to compress spring 315 and cause first end 310 to enter housing 320 (see FIG. 4). As luminaire module 110 is continued to be rotated, the first end 310 enters an adjacent recess 145 along the diagonally oriented row 114. In this case the force on first end 310 is relieved and spring 315 extends to force first end into the adjacent recess 145.

Also illustrated, between each of two rows 114, represented as 114*a*, 114*b*, is a second ridge 520 oriented substantially parallel to rows 114. In one aspect of the invention, second ridge 520 is higher than ridges 510 to define rows 114 and retain catch mechanism 140 is a desired row 114 as finish section 110 is rotated. As would be appreciated, as luminaire module 110 is rotated, catch mechanism 140 traverses from one recess 145 to a next recess 145 within a same row 114. As each recess 145 is oriented at a slight different vertical position, finish section 110 is raised or lowered as the finishing section 110 is rotated. In addition, the application of a vertical force to luminaire module 110 raises the luminaire module 110 to engage a next higher or lower oriented row 114.

In accordance with the principles of the invention, when installing a luminaire module 110, a user may insert the luminaire module 110 into an opening 26 (FIG. 2). In this case, the catch mechanism 140 may slide along a smooth surface of outer surface of luminaire module 110 (where the texture surface does not exist) or over the second ridges 520 in the outer surface of luminaire module 110 until the luminaire module 110 is in a near flush position with visible surface of plate 24 (or a ceiling). The user may then rotate the luminaire module 110 to further raise luminaire module 110. In this case, the catch mechanism 140 slides over first ridges 510 as the catch mechanism 140 proceeds from recess 145 to an adjacent recess 145 along a same one of the rows 114. In one aspect of the invention, the rows 114 of recesses 145 may be oriented along parallel diagonal lines that raise (or lower) the luminaire module 110 by a predetermined distance as luminaire module 110 is rotated. In one aspect of the invention, the luminaire module 110 may be raised or lowered by 0.030 inches, for example, for each movement of catch mechanism 140 from one recess 145 to an adjacent second recess 145 within a same row 114.

As would be appreciated, the predetermined distance that the luminaire module 110 vertically moves for each rotation of luminaire module 110 is determined based on the slope of the diagonal, coiled path or orbital path orientation of rows 114 with regard to a horizontal plane.

Other variations to the disclosed embodiments can be understood and effected by those skilled in the art in practicing the claimed invention, from a study of the drawings, the disclosure, and the appended claims.

While there has been shown, described, and pointed out fundamental and novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention.

It is expressly intended that all combinations of those elements that perform substantially the same function in substantially the same way to achieve the same results are within the scope of the invention. Substitutions of elements from one described embodiment to another are also fully intended and contemplated.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The term "comprises", "comprising", "includes", "including", "as", "having", or any other variation thereof, are intended to cover non-exclusive inclusions. For example, a process, method, article or apparatus that comprises a list of elements is not necessarily limited to only those elements but may include other elements not expressly listed or inherent to such process, method, article, or apparatus. In addition, unless expressly stated to the contrary, the term "or" refers to an inclusive "or" and not to an exclusive "or". For example, a condition A or B is satisfied by any one of the following: A is true (or present) and B is false (or not present); A is false (or not present) and B is true (or present); and both A and B are true (or present).

Any reference signs in the claims should not be construed as limiting the scope of the claims or the invention described by the subject matter claimed.

What is claimed is:

1. A light fixture assembly comprising:

a finishing section including at least one textured surface partially covering said finishing section, said textured surface including a plurality recesses arranged in a plurality of rows and a plurality of columns, said plurality of rows oriented along adjacent diagonal lines and said plurality of columns in adjacent vertical lines, said pluralities of rows and columns forming a grid that include the plurality of recesses; and a retaining ring surrounding said finishing section, said retaining ring including a catch mechanism engaging a corresponding one of said at least one textured surface, wherein said at least one catch mechanism comprises at least one of: a bullet catch and a ball catch, and wherein the at least one of the bullet catch and the ball catch is configured to engage any recess in the grid by movement in a vertical direction or a diagonal direction along the grid.

2. The light fixture assembly of claim 1, wherein an orientation of one of said diagonal lines is determined based on a desired vertical movement of said finishing section as said finishing section is rotated.

3. The light fixture assembly of claim 1, wherein said mechanism is slideably engageable within said corresponding textured surface.

4. The light fixture assembly of claim 1, wherein said retaining ring is included within a plate.

5. The light fixture assembly of claim 1, wherein said retaining ring is included within a housing.

6. The light fixture assembly of claim 1, wherein said at least one texture surface is oriented substantially equally around said finishing section.

7. The light fixture assembly of claim 1, wherein said catch mechanism is oriented substantially equally around said finishing section.

8. The light fixture assembly of claim 1, wherein said finishing section is one of: a luminaire module and a reflector.

9. The light fixture assembly of claim 1, wherein said plurality of rows are oriented with respect to a horizontal line with one of: a positive slope and a negative slope.

10. A recessed light fixture comprising:

a housing comprising:

a retaining ring surrounding an opening in said housing, said retaining ring including a plurality of catch mechanisms; and a finishing section, said finishing section including an outer surface, said outer surface including a plurality of textured surfaces partially covering outer surface, each of said plurality of textured surfaces including a plurality recesses arranged in a plurality of rows and a plurality of columns, said plurality of rows being oriented along diagonal lines and said plurality of columns in adjacent vertical lines, said pluralities of rows and columns forming a grid that include the plurality of recesses, wherein one of said plurality of said textured surfaces engaging a corresponding one of said plurality of catch mechanisms, wherein said plurality of catch mechanisms comprises at least one of: a bullet catch and a ball catch, and wherein the at least one of the bullet catch and the ball catch is configured to engage any recess in the grid by movement in a vertical direction or a diagonal direction along the grid.

11. The recessed light fixture of claim 10, wherein an orientation of one of said diagonal lines is determined based on a desired vertical movement of said finishing section as said finishing section is rotated.

12. The recessed light fixture of claim 10, wherein a number of said at least one textured surface is at least comparable to a number of said plurality of catch mechanisms.

13. The recessed light fixture of claim 10, wherein said at least one texture surface is oriented substantially equally around said finishing section.

14. The recessed light fixture of claim 10, wherein said plurality of catch mechanisms is oriented substantially equally around said finishing section.

15. The recessed light fixture of claim 10, wherein said plurality of rows are oriented with respect to a horizontal line with one of: a positive slope and a negative slope.

* * * * *